US006474091B2

(12) United States Patent
Guerra

(10) Patent No.: US 6,474,091 B2
(45) Date of Patent: Nov. 5, 2002

(54) ILLUSIONARY SNOW APPARATUS

(76) Inventor: Francisco Javier Guerra, 9715 W. Broward Blvd. #217, Plantation, FL (US) 33324

( * ) Notice: Subject to any disclaimer, the term of this patent is extended or adjusted under 35 U.S.C. 154(b) by 0 days.

(21) Appl. No.: 09/996,175

(22) Filed: Nov. 20, 2001

(65) Prior Publication Data

US 2002/0033026 A1 Mar. 21, 2002

Related U.S. Application Data

(63) Continuation-in-part of application No. 09/664,271, filed on Sep. 18, 2000, now Pat. No. 6,321,559.

(51) Int. Cl.[7] ..... F25C 1/00
(52) U.S. Cl. ..... 62/347; 239/2.2
(58) Field of Search ..... 62/347; 239/2.2

(56) References Cited

U.S. PATENT DOCUMENTS

| | | | | | |
|---|---|---|---|---|---|
| 3,999,750 | A | * | 12/1976 | Perkins | 137/268 |
| 4,214,700 | A | * | 7/1980 | Vanderkelen et al. | 239/132.5 |
| 4,223,836 | A | * | 9/1980 | Eager | 239/14.2 |
| 4,711,395 | A | * | 12/1987 | Handfield | 239/14.2 |
| 4,813,598 | A | * | 3/1989 | Kosik et al. | 239/2.2 |
| 4,828,175 | A | * | 5/1989 | Heufler et al. | 181/202 |
| 5,918,477 | A | * | 7/1999 | Gall et al. | 62/354 |
| 6,129,290 | A | * | 10/2000 | Nikkanen | 239/132.1 |

* cited by examiner

*Primary Examiner*—William E. Tapolcai
*Assistant Examiner*—Mohammad M Ali
(74) *Attorney, Agent, or Firm*—David W. Barman

(57) ABSTRACT

A Machine and method for producing the illusion of snow is disclosed and described. It produces said product in a manner such that is easier to manufacture, operate, and produce than is currently available.

7 Claims, 5 Drawing Sheets

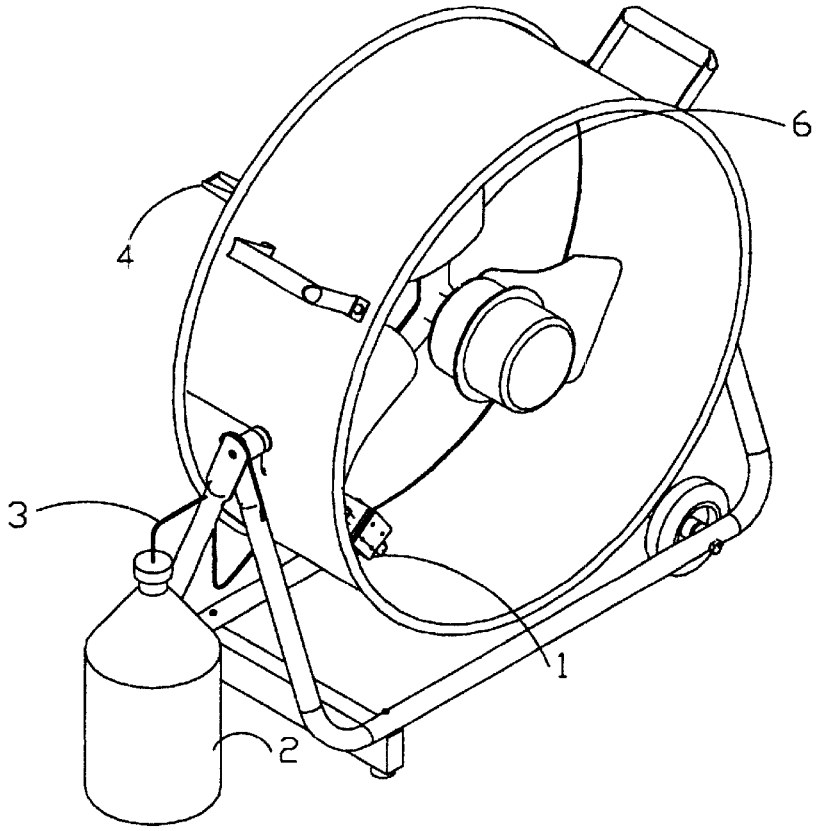
FIG 1
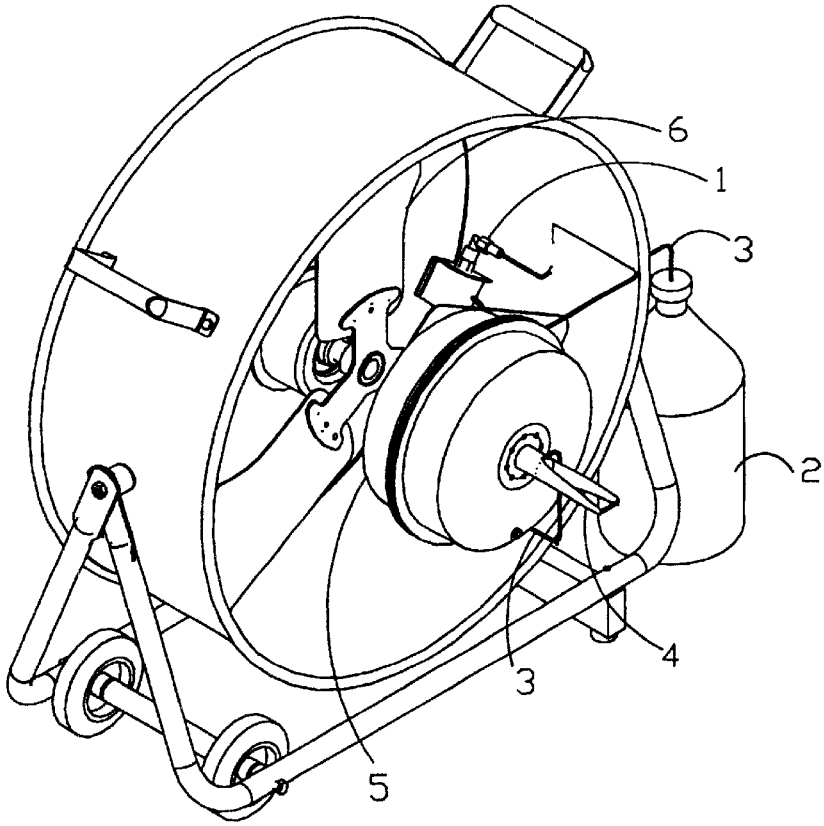

ILLUSIONARY SNOW APPARATUS

CROSS REFERENCE TO RELATED APPLICATIONS

This is a continuation-in-part of patent application Ser. No. 09/664,271 filed Sep. 18, 2000, now U.S. Pat. No. 6,321,559.

FIELD OF THE INVENTION

This invention relates to the production of illusioanry snow. More particularly, a machine which capable of creating the illusion of snow for theatrical or special effect purposes without the use of refrigeration, and without causing the accumulation of any residual moisture in the area in which it is used.

BACKGROUND OF THE INVENTION

The world of theater and special effects has prided itself on the ability to create illusions. The masters of this art are continually creating their magic for the entertainment of their patrons. One of the most challenging illusions is that of snow. This presents a distinct difficulty. Limitations based on temperature and accumulation of moisture have always plagued the special effects creators.

There are many commercially available machines for producing snow. Many of these liquid based snow machines have been able to produce artificial snowflakes. The flakes formed were tight groupings of bubbles that were moist and had a tendency to clump together. This caused difficulty in dissipation. Additionally, there were concerns regarding moisture buildup in the area in which the machine was used. The problems of slippery floors, surfaces, and staining from the product have not been overcome. In an attempt to overcome these problems, people have attempted the use of fans in order to more widely distribute the artificial snow produced by these earlier machines. However, the flakes tend to form agglomerates which are not substantially effected by the auxiliary fans. These auxiliary fans do not overcome the physical difficulty of moisture buildup or the danger, which it presents.

The current invention overcomes these deficiencies. It provides for the creation of illusionary snow by an apparatus that utilizes a solution, which is commercially available as FG-100 Evaporative Snow (manufactured by Snow Masters, Plantation Fla.) drawn into a turbulent carrier wave of air at the same point at which the flakes are produced. The preciseness of placement of the carrier wave prevents tight clumps from forming, and causes greater separation between the flakes. Once the individualized flakes are carried from the machine, the evaporative process occurs and prevents moisture buildup.

BRIEF DESCRIPTION OF THE DRAWINGS

FIG. 1 shows a complete illusionary snow machine that incorporates all of the aspects of the invention.

DETAILED DESCRIPTION OF THE PREFERRED EMBODIMENT

Figure 2:
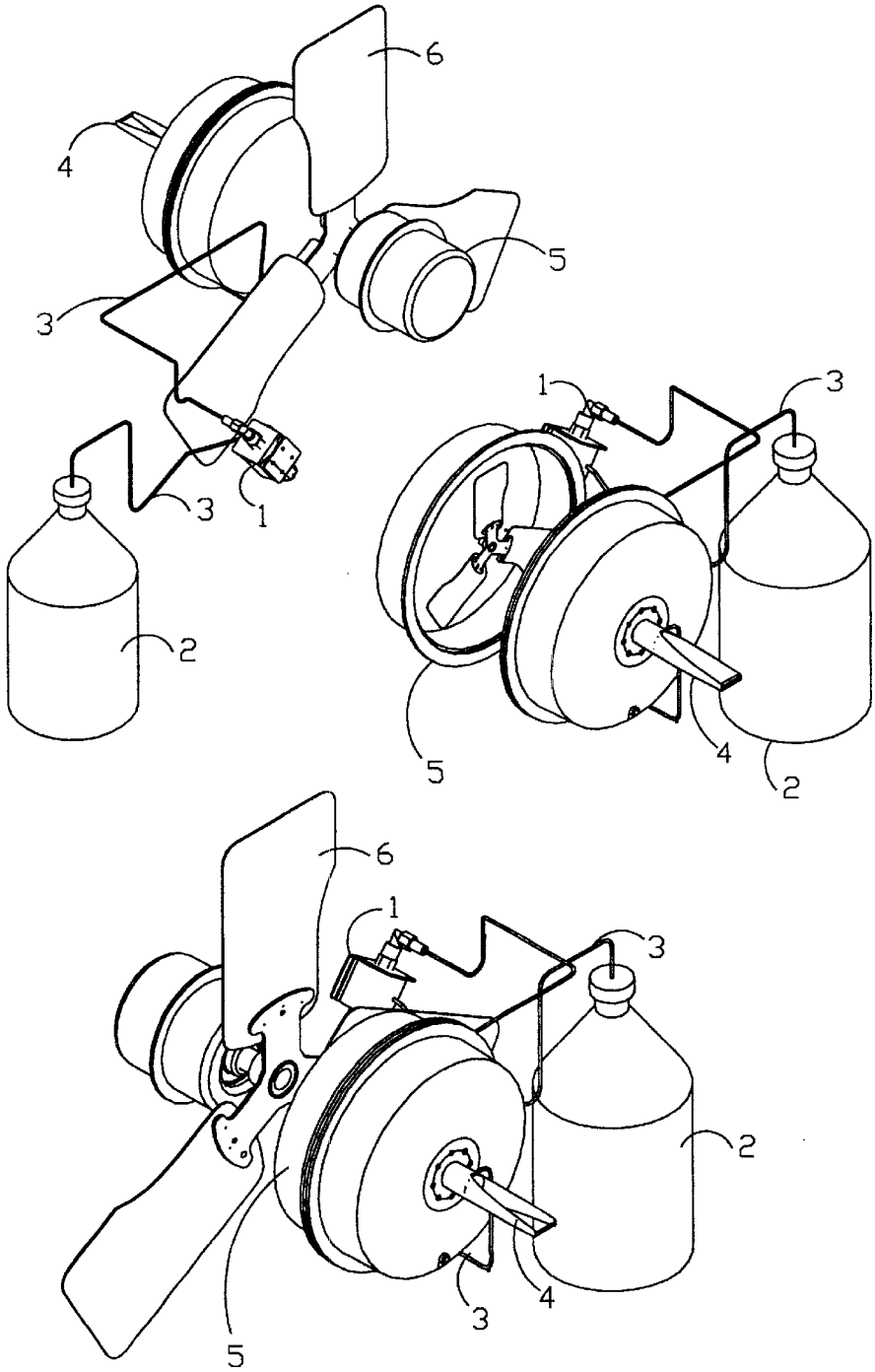
FIG. 2 illustrates the pump with connecting hose and the flake generator.

The ilusionary snow solution 2 under pressure is drawn into connecting hose 3 by means of an in-line liquid pump

1 at a rate of 4 ounces per minute. The liquid then continues to a flake generator 7 where it saturates a sock 4. An impeller 5 contained within flake generator 7 causes flakes to form and to be projected into the air while an integrated carrier fan 6 facilitates the distribution of individual flakes. The flake generator 7 will produce a constant 3000 cubic feet per minute of airflow. This volume of air is forced through sock 4 and holes 8, which are on the outer surface of flake generator 7. Pressure of the air coming through sock 4 causes flakes to be formed on the outer surface of said sock 4. The volume of air produced by impeller 5 that exits flake generator 7 through the holes 8 lift the flakes from the surface of sock 4. Once the flakes are lifted from sock 4, they are projected away from the apparatus by means of airflow produced by carrier fan 6. When the force of air contacts the flakes produced carrier fan 6 there are two physical phenomena that occur. First the flakes are broken into smaller particles. This is a novel part of the current invention. The other commercially available machines have a great tendency to produce larger agglomerates, which in turn lead to excessive moisture buildup in the surrounding area. Second, once the flakes are separated into smaller particles, they are more easily dispersed in the area away from the machine. Once they are in the air in this matter the overall ratio of surface area exposed to air greatly increases. With this increased surface are comes a greater ability to speed the evaporative process. These two factors combine to speed the evaporative process and make it more complete. Another novelty of the current invention lies in the design of carrier fan 6 being lined up with flake generator 7 to lift the flakes and eject them from the apparatus in a manner that is greatly increased then a machine that would not contain both of these features placed together and at a proper distance from one another. This allows the flakes to remain in the air for a longer period of time and thus increases the transit time before they reach the ground. This increased time provides more exposure to air and allows for the completeness of evaporation to occur. The final result is an evaporative artificial snowfall that is truly free from residue of any type. Additionally, the snow produced does not resemble typical artificial snow that is ejected from a carrier hose or other apparatus. The current invention lifts the illusionary snow in a manner that produces a gentle cloud of snow in a wider horizontal area. The individualized flakes provide a cloud of gently falling flakes that is truly more realistic than anything currently available.

In one embodiment it has been found that one need not place the carrier fan in a centered position behind the flake generator. It has further been discovered that when placing a drum fan outlet below the flake generator and sock, one can produce a greater amount of illusionary snow, without increasing the velocity of the air from the carrier fan. In using a drum fan with the current invention, it has been discovered that a very large volume of illusionary snow can be produced. The volume is such that this embodiment allows the subject invention to be used in large arenas and stadiums. The same velocity of 3000 cubic feet per minute will generate a noticibly increased amount of illusionary snow. This is an important feature because without the need or increased air velocity, there is no increase in any noise created by the apparatus. If the apparatus were to be used indoors eg. in the theater, the amount of noise created would be minimal. Additionally, with the increased efficiency comes the ability of the user to regulate the flow rate of the solution into the apparatus. The solution can have a flow rate between 1–4 ounces per minute and still produce illusionary snow.

Figure 3:
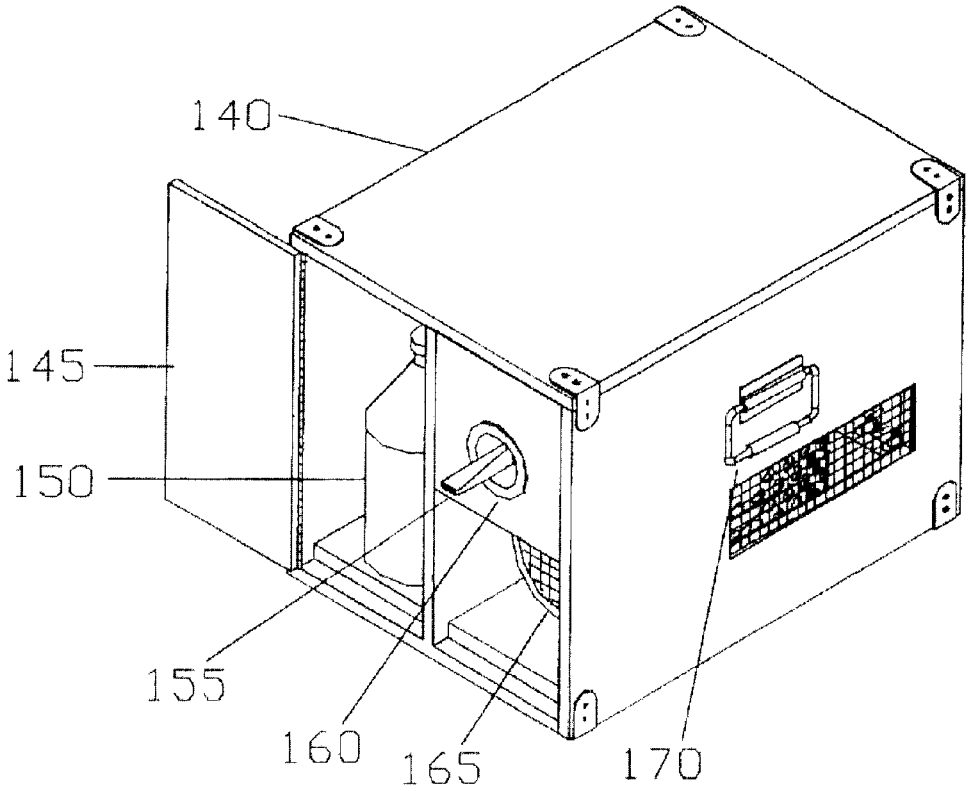
FIG. 3 illustrates a front view of the apparatus

FIG. 3 illustrates an embodiment with apparatus housed within a case 140 which has a handle 170 on either side to facilitate carrying. A container 150 for holding the solution is placed inside when opening door 145. The sock 155 as previously described is mounted on the front upper portion of the apparatus. An outlet air exhaust 165 provides air from the carrier fan.

Figure 4:
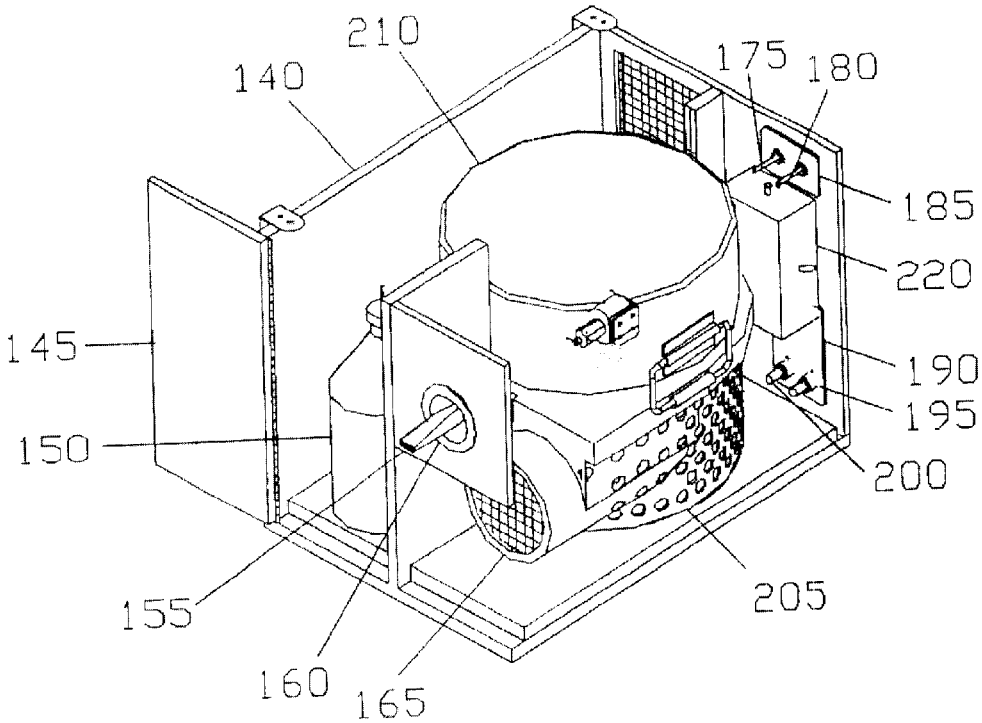
FIG. 4 illustrates the apparatus in a cut away from the front

FIG. 4 shows the interior of the case 140 in which a drum fan 205 as is comonly known in the art, is used to produce the necessary velocity to project the illusionary snow from the apparatus. There is a plate 185 for holding inlets 175 and 185 through which a remote control means can be connected to operate the apparatus. The circuit board 220 receives electrical power from either electrical inlet 195 or 200 which are secured to case 140 by means of a connecting plate 190 and can be controlled through a suitable controlling means as connected to either connector 175 or 180.

Figure 5:
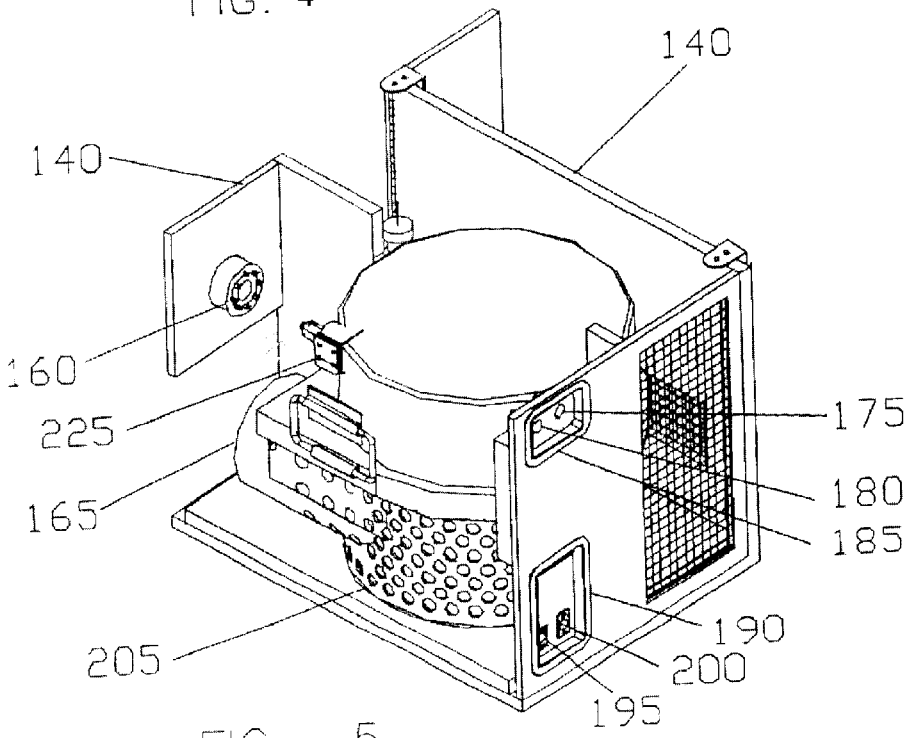
FIG. 5 illustrates the apparatus in a cut away from the rear

FIG. 5 illustrates the aforementioned elements, and additionally shows placement of the flake generator 160 and the pump 225.

The method for producing an illusionary snowfall which employs an evaporative snow solution, is a method comprising the steps of: Supplying electricity to the unit and drawing said evaporative snow solution into an apparatus through a hose, which is connected to a pump, directing said solution from said pump to a flake generator, which forms flakes on the outer surface of a sock, said flake generator comprises an impeller which disperses evaporative snowfall away from the apparatus, and a carrier fan which provides added velocity in projecting the illusionary snow from the apparatus.

Figure 6:
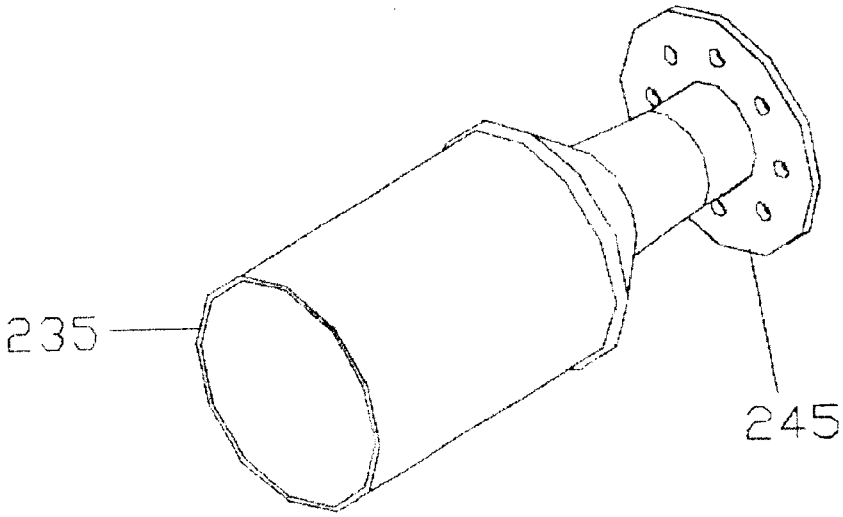
FIG. 6 is a foam streamer attachment
Figure 7:
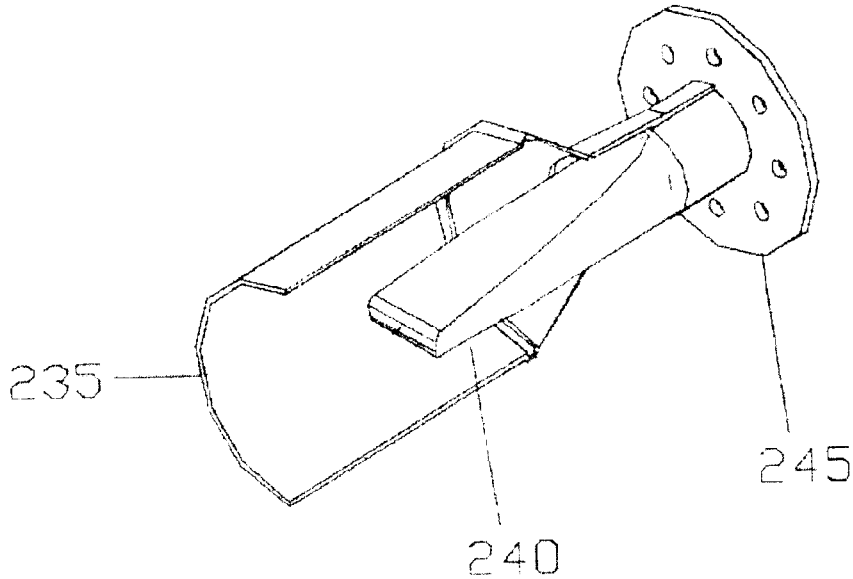
FIG. 7 illustrates the foam streamer in a cut away

In a further embodiment of the subject invention it has been discovered that if one prevents the air from the holes on the outer surface of the flake generator, from reaching the sock, the illusionary snow will be produced in larger form as opposed to individual flakes. FIG. 6 illustrates an attachment which is connected to the outside of the flake generator and prevents the air from the holes on the outside of the flake generator from removing individualized flake. The air flow from the flake generator that reaches the sock, creates a solid form. In this embodiment, a cylindrical sheild 235 prevents air from the holes on the outer surface of the flake generator 245 from reaching the sock. FIG. 7 shows the position of a sock 240 within the cylindrical shield. In this embodiment, the cylindrical sheild produces long cylindical columns of illusionary snow. These long cylindrical columns are carried from the sock by air that reaches the sock from the flake generator. Once the cylindrical column exits the cylindrical shield, the carrier fan propels it away from the apparatus. One can make the shield in various shapes in order to change the shape of the column.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A machine for producing an evaporative snow as small individualized particles which are easily dispersed, are free from agglomerates and leave no moisture or residue in the area of use, said machine comprising a pump to deliver an evaporative snow solution to a flake generator, said flake generator comprising an impeller which causes flakes to form on the surface of a sock, said flakes are dispersed from said sock by the air flow created by said impeller and optionally means for limiting air flow from the surface outlet of said flake generator to the sock.

2. The machine of claim 1 in which the pump operates at a rate of 1–4 ounces per minute.

3. The machine of claim 1 in which the impeller lifts the illusionary snow off said sock.

4. The machine of claim 1 in which the impeller creates airflow to further disperses the illusionary snow into an area away from the machine.

5. The machine of claim 1 in which the carrier fan is placed with an air outlet below said sock.

6. The machine of claim 1 in which said means for restricting air flow from the surface of the flake generator to the sock is a shield.

7. The machine of claim 6 in which said shield produces columns of illusionary snow.

* * * * *